US012460434B2

(12) United States Patent
Muhaysin et al.

(10) Patent No.: US 12,460,434 B2
(45) Date of Patent: Nov. 4, 2025

(54) APPARATUS FOR QUICK-DEPLOY SCAFFOLDING

(71) Applicants: Muhammad Muhaysin, Clifton, NJ (US); Arkadiusz Swechowicz, Forest Hills, NY (US); Rami Taha, Bronx, NY (US)

(72) Inventors: Muhammad Muhaysin, Clifton, NJ (US); Arkadiusz Swechowicz, Forest Hills, NY (US); Rami Taha, Bronx, NY (US)

( * ) Notice: Subject to any disclaimer, the term of this patent is extended or adjusted under 35 U.S.C. 154(b) by 901 days.

(21) Appl. No.: 17/553,673

(22) Filed: Dec. 16, 2021

(65) Prior Publication Data

US 2023/0193641 A1 Jun. 22, 2023

(51) Int. Cl.
*E04G 5/04* (2006.01)
*E04G 3/20* (2006.01)
*E04G 3/22* (2006.01)

(52) U.S. Cl.
CPC ..... *E04G 5/048* (2013.01); *E04G 3/20* (2013.01); *E04G 3/22* (2013.01)

(58) Field of Classification Search
CPC ..... E04G 3/20; E04G 3/22; E04G 21/3238; E04G 21/3276; E04G 5/048; E04G 5/062
See application file for complete search history.

(56) References Cited

U.S. PATENT DOCUMENTS 5,065,838 A * 11/1991 Finley ..... E04G 3/34 182/150
6,227,553 B1 * 5/2001 Palmer ..... E04G 21/3261 414/673
11,923,595 B2 * 3/2024 Nakachi ..... H01Q 1/125
12,264,473 B1 * 4/2025 Cechini ..... E04B 1/388

* cited by examiner

*Primary Examiner* — Jessica L Laux
(74) *Attorney, Agent, or Firm* — Mohamed C. Azeez

(57) ABSTRACT

An apparatus for suspended scaffolding, comprising a Z-shaped anchoring plate comprised of a first horizontally protruding element, a second opposable protruding element, and said elements continuously coupled to each other via a vertical middle element, wherein the Z-shaped plate is configured to securely cover at least portions of a top wall, inner wall of a parapet, and a roof; at least one threaded rod with torqued nut anchored through at least one of the vertical element and/or the first element of the anchoring plate and through at least one of the top wall, inner wall, and/or outer wall of the parapet; an L-shaped receiver plate secured over at least a portion of the top wall and outer wall of the parapet and rod-nut anchored to the anchoring plate, wherein the receiver plate is configured to secure a suspended scaffold for a user to engage a façade of a structure in any direction; and a counterweight securely rested on a top surface of the second element in order to counter the weight of the suspended scaffold.

9 Claims, 9 Drawing Sheets

APPARATUS FOR QUICK-DEPLOY SCAFFOLDING

BACKGROUND OF THE INVENTION

A. Technical field

The present invention generally relates to a construction scaffold accessory, and more specifically relates to an apparatus for a quick-deploy scaffolding with minimal or no parapet engagement, in addition to a mobile tie-back avoiding parapet engagement for ensuring quick and safe suspended scaffolding for time-constrained and structurally tenuous construction projects.

B. Description of related art

All multi-story façade repair or maintenance requires a suspended scaffold to allow contractors to engage with the façade. Whether single point or multi-point; needle-beam, catenary, or floating-safe use of the suspended scaffolding always begins and ends with a secure anchorage. To that end, contractors often require detailed plans submitted to a respective Department of Buildings office for requisite permits-permits that have been known to take months before any outrigger can be installed for secure anchoraging. These permits referred to as CD5 (Crane and Derricks 5) permits in the city of New York, require an exhaustive submission and review process requiring extensive drawing and elevation plans, including for shed, sidewalk, tie-back drawings, etc. These permits have been known to take at least two to three months-effectively halting any project until permits are secured. Now with Covid related backlogs, it is not uncommon to hear about a four to the six-month waiting period for the CD5 permit. Notwithstanding the backlog, the city continues to require detailed submissions and a rigorous approval process given the safety implications involved for workers and passersby alike. The lack of uniformity in roof and parapet conditions/dimensions across city structures necessitates this rigorous approval process.

In addition to the bureaucratic challenges, there are several engineering challenges that many of the pre-war structures of some of the earlier settled cities in our country present—and New York City is no exception. According to a recent New York Times article, over forty percent of pre-war buildings (grandfathered) would not conform to the current building code for one reason or the other. The primary reason is structurally unsound roof and parapet conditions. To that end, engineers and contractors must make special accommodations for roof/parapet reinforcement and documented as part of the initial CD5 submission. This expanded submission-only prolongs the pendency of CD5 permits.

Therefore, there is a need for an apparatus that addresses the twin-fold issues of a lack of standardization in the deployment of suspended scaffolds and structural soundness of roof and parapets.

SUMMARY OF THE INVENTION

The present invention relates to an apparatus for addressing the twin-fold issues of a lack of a standardized set-up and deployment of suspended scaffolds that obviates the need for roof/parapet reinforcement. The apparatus is further configured to enable a standardized/scalable quick-deployment of a suspended scaffold for building façade repair that does not require detailed plans and/or an extensive review process-along with the need for roof/parapet reinforcement.

In one embodiment, the apparatus includes a first element with a surface and a second perpendicular element with a surface resting on a roof or roof support. The second resting element is configured to receive or house at least a single counterweight, while the first element is coupled to at least one of a suspension scaffold, receiver plate, steel cables, or tie-back accessory. In one embodiment, the apparatus comprises a Z-shaped plate, wherein the first element is opposable to the second element resting on a roof/support surface with counterweight, while the first element and opposable second element are continuous/conjoined by a middle element. The first element is coupled to at least one of a suspension scaffold, receiver plate, steel cables, or tie-back accessory. The middle element optionally may be disposed of with through-plates (aperture/holes/threaded holes) for receiving steel cables or any other type of tie-back accessory for using the apparatus as a tie-back instrument, rather than relying on an unsound roof protrusion or parapet. The desired effect is a standardized, quick-deploy of a suspension scaffold/tie-back for performing façade repair-obviating the need for extensive drawing plans, lengthy approval process, or additional parapet/roof reinforcement.

In one embodiment, a Z-shaped anchoring plate is comprised of a first horizontally protruding element, a second opposable protruding element, and said elements continuously coupled to each other via a vertical middle element, wherein the Z-shaped plate is configured to securely cover at least portions of a top wall, inner wall of a parapet, and a roof; at least one threaded rod with torqued nut anchored through the vertical element of the anchoring plate and the parapet; an L-shaped receiver plate secured over at least a portion of the top wall and outer wall of the parapet and rod-nut anchored to the anchoring plate, wherein the receiver plate is configured to secure a suspended scaffold for a user to engage a façade of a structure in any direction; and a counterweight securely rested on a top surface of the second element to counter the weight of the suspended scaffold.

In another embodiment, the apparatus may be completely disengaged with a parapet by the use of an intervening support arm between the parapet and apparatus. A Z-shaped anchoring apparatus with an intervening support arm comprising: a Z-shaped anchoring plate comprised of a first horizontally protruding element, a second opposable protruding element, and said elements continuously coupled to each other via a vertical middle element; a support arm positioned between the vertical middle element of the anchoring plate and a back wall of the parapet, wherein the Z-shaped plate is configured to securely cover at least portions of a top wall of the parapet, the top wall of the arm, and a roof; at least one rod-nut anchoring the top wall of the arm with the first element of the anchoring plate to secure a suspended scaffold for vertical mobility for a user to engage a façade of a structure; and a counterweight securely rested on a top surface of the second element to counter the weight of the suspended scaffold.

In yet another embodiment, the apparatus may not require the presence of a parapet at all—and instead, use at least one support arm for load-bearing (free-standing apparatus). The free-standing apparatus comprising a Z-shaped anchoring plate comprised of a first horizontally protruding element, a second opposable protruding element, and said elements continuously coupled to each other via a vertical middle element; a vertical arm with a top surface and at least one vertical surface, wherein said arm is positioned between the vertical middle element and the first protruding element of the anchoring plate, wherein the Z-shaped plate is configured to securely cover at least portions of the top and vertical surfaces of the arm, and a roof; at least one rod-nut anchoring the top wall of the arm with the first element of the anchoring plate to secure a suspended scaffold for vertical mobility for a user to engage a façade of a structure; and a counterweight securely rested on a top surface of the second element to counter the weight of the suspended scaffold.

In addition to an anchoring apparatus for quick-deploy scaffolding, the apparatus may additionally serve as a tie-back instrument without requiring engagement with a parapet or roof structure/protrusion. This proves invaluable in the event of structurally unsound roof/parapet condition and/or a protracted review process for roof/parapet shoring proposals.

In one other embodiment, a method for fabricating or assembling the quick-deploy apparatus comprises the steps of: fabricating a Z-shaped anchoring plate as a single unitary piece, with a first protruding element continuous with a second opposable protruding element by a middle vertical element, wherein the plate is configured to securely cover at least portions of a top wall and/or inner wall of a parapet and a roof; anchoring at least one threaded rod with a torqued nut through at least one of the vertical element and/or the first element of the anchoring plate and through at least one of the top wall, inner wall, and/or outer wall of the parapet; securing an L-shaped receiver plate over at least a portion of the top wall and outer wall of the parapet and rod-nut anchoring said receiver plate to the anchoring plate, wherein the receiver plate is configured to secure a suspended scaffold for a user to engage a façade of a structure in any direction; and resting a counterweight securely over a top surface of the second element in order to counter the weight of the suspended scaffold.

Finally, in another embodiment, a method for a tie-back during suspended scaffolding comprises the steps of: fabricating a Z-shaped anchoring plate with a first horizontally protruding element continuous with a vertical element and an opposable second horizontally protruding element; traversing the first element with at least a single hole configured to slidably receive a cable to serve as a tie-back distally situated from a suspended scaffold hanging from a proximal end, and resting a counterweight securely on a top surface of the second element to counter the weight of the suspended scaffold. Other embodiments may entail just two elements conjoined with distinct surfaces, wherein one surface is intended for resting on a roof surface, and the other surface couples to the tie-back accessory, scaffolding, receiver plate, etc.

Other objects, features, and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The embodiments herein will be better understood from the following detailed description concerning the drawings, in which.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1C:
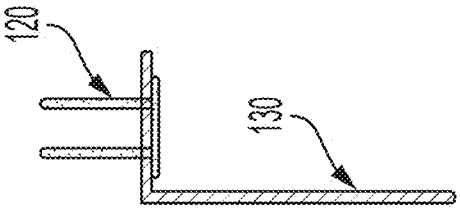
FIG. 1C exemplarily illustrates an anchoring apparatus according to one or more aspects of the invention.
Figure 1B:
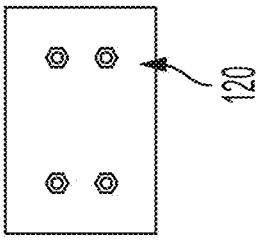
FIG. 1B exemplarily illustrates an anchoring apparatus according to one or more aspects of the invention.
Figure 1A:
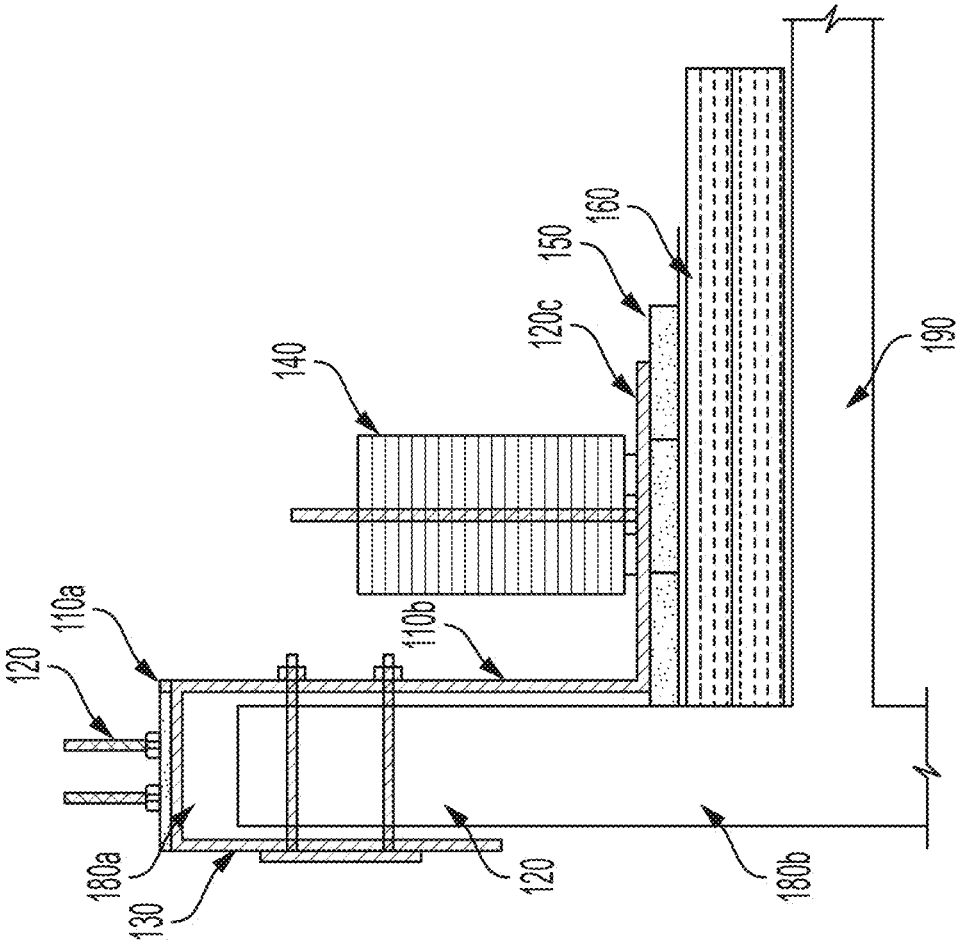
FIG. 1A exemplarily illustrates an anchoring apparatus according to one or more aspects of the present invention.

The present invention discloses an apparatus for quick-deploy scaffolding. The apparatus is further configured to enable a contractor/rigger to quickly assemble/disassemble a standardized anchor for scaffolding/tie-back-even under sub-optimal roof/parapet structural conditions. The appended figures (FIGS. 1*a*-7) exemplarily illustrate various embodiments of the anchoring apparatus or parapet reinforcement apparatus in accordance with aspects of the invention, including for: a through-parapet; a parapet-supported; an arm-supported; and tie-back versions. Referring to FIG. 1A-1C and 2A-2C, both of which exemplarily illustrate a Z-shaped anchoring apparatus, including for a counterweight opposably disposed from a receiver plate configured to engage a suspended scaffold parallel with an elevation of a building under façade repair. FIG. 1A-1C exemplarily illustrates a through-parapet Z-shaped anchoring apparatus, while FIG. 2A-2C exemplarily illustrates a parapet-supported Z-shaped anchoring apparatus. In instances of sub-optimal parapet conditions (deteriorating coping stone/cap, clad, wall, etc.), the parapet-supported anchoring apparatus may be preferred due its minimal invasiveness.

Now in particular reference to FIG. 1A, illustrating a through-parapet Z-shaped apparatus for suspended scaffolding comprising: a Z-shaped anchoring plate 110 comprised of a first horizontally protruding element 110*a*, a second opposable protruding element 110*c*, and said elements continuously coupled to each other via a vertical middle element 110*b*, wherein the Z-shaped plate 110 is configured to securely cover at least portions of a top wall 180*a*, inner wall of a parapet 180*b*, and a roof 190; at least one threaded rod with torqued nut 120 anchored through at least one of the vertical element 110*b* and/or the first element 110*a* of the anchoring plate 110 and through at least one of the top wall, inner wall, and/or outer wall of the parapet 180; an L-shaped receiver plate 130 secured over at least a portion of the top wall 180*a* and outer wall of the parapet 180*b* and rod-nut anchored 120 to the anchoring plate 110, wherein the receiver plate 130 is configured to secure a suspended scaffold for a user to engage a façade of a structure in any direction; and a counterweight 140 securely rested on a top surface of the second element 110*c* in order to counter the weight of the suspended scaffold.

FIG. 1B illustrates a plan view of the receiver plate 130, clearly depicting four threaded rods 120 that are nut-torqued through each plate 130 and a top and/or inner/outer wall of the parapet 180. FIG. 1C illustrates a section view of the receiver plate 130, revealing two of the four nut-torqued rods 120 (2×2) traversing a top portion of the receiver plate 130 and a top wall of the parapet (not shown).

Figure 2C:
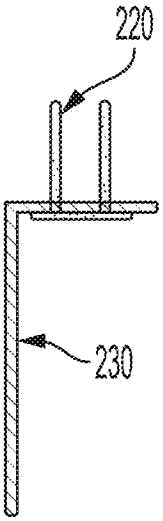
FIG. 2C exemplarily illustrates an anchoring apparatus according to one or more aspects of the invention.
Figure 2B:
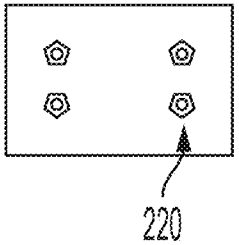
FIG. 2B exemplarily illustrates an anchoring apparatus according to one or more aspects of the invention.
Figure 2A:
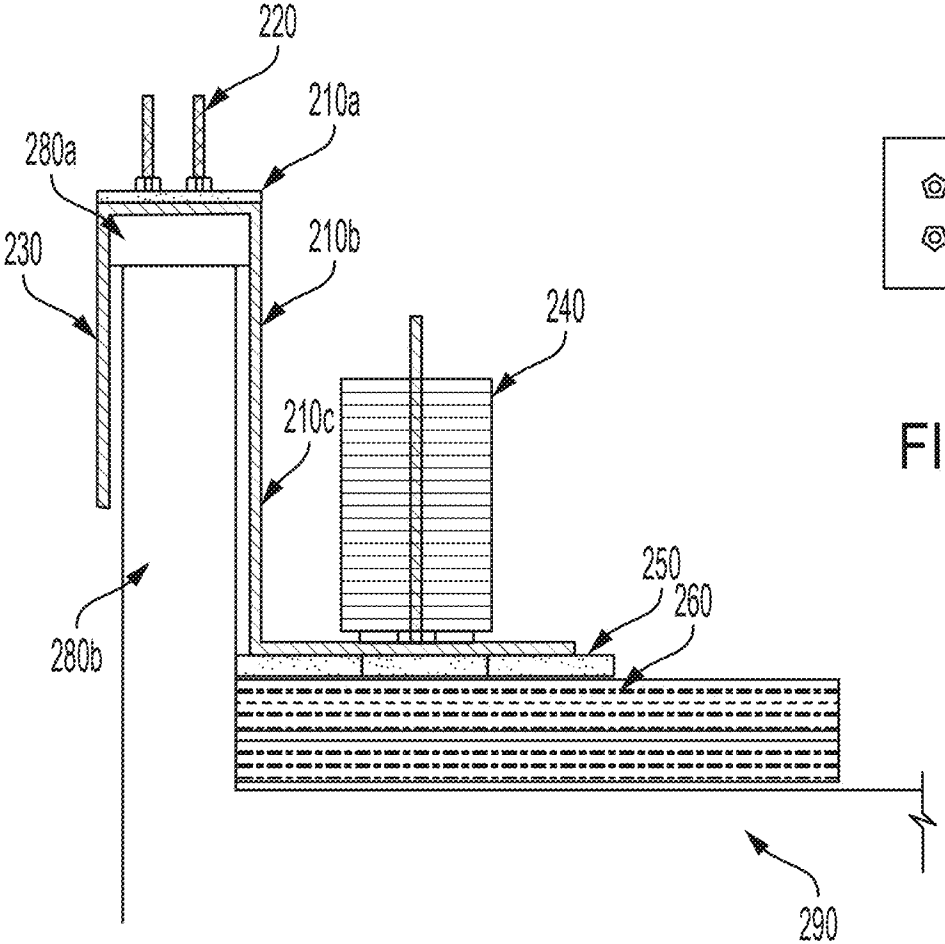
FIG. 2A exemplarily illustrates an anchoring apparatus according to one or more aspect of the present invention.

Now in particular reference to FIG. 2A, which illustrates a parapet-supported apparatus for suspended scaffolding comprising: a Z-shaped anchoring plate 210 comprised of a first horizontally protruding element 210*a*, a second opposable protruding element 210*c*, and said elements continuously coupled to each other via a vertical middle element 210*b*, wherein the Z-shaped plate 210 is configured to securely cover at least portions of a top wall 280*a*, inner wall of a parapet 280*b*, and a roof 290; at least one threaded rod with torqued nut 220 anchored through at least one of the vertical element 210*b* and/or the first element 210*a* of the anchoring plate 210 and through at least one of the top wall, inner wall, and/or outer wall of the parapet 280; an L-shaped receiver plate 230 secured over at least a portion of the top wall 280*a* and outer wall of the parapet 280*b* and rod-nut anchored 220 to the anchoring plate 210, wherein the receiver plate 230 is configured to secure a suspended scaffold for a user to engage a façade of a structure in any direction; and a counterweight 240 securely rested on a top surface of the second element 210*c* in order to counter the weight of the suspended scaffold.

This parapet-supported anchoring apparatus may prove efficient in scenarios of low through-wall tolerance due to its non-invasive anchoring. In certain embodiments, the rod-nut anchoring may traverse the top wall of the Z-shaped apparatus and L-shaped receiver plate, while not traversing the top wall or vertical wall (outer/inner) of the parapet-avoiding any additional compromise of a structurally unsound parapet wall and avoiding any parapet reinforcement strategies. A certain degree of structural soundness is required to tolerate the anchoring of the nut-torqued rod-either through the vertical wall and/or top wall of the parapet. FIG. 2B illustrates a plan view of the receiver plate 230, clearly depicting four threaded rods 120 (2×2) that are nut-torqued through each plate 230 and a top and/or inner/outer wall of the parapet 180. FIG. 2C illustrates a section view of the receiver plate 230, revealing two of the four nut-torqued rods 220 traversing a top portion of the receiver plate 230 and a top wall of the parapet (not shown).

Figure 3:
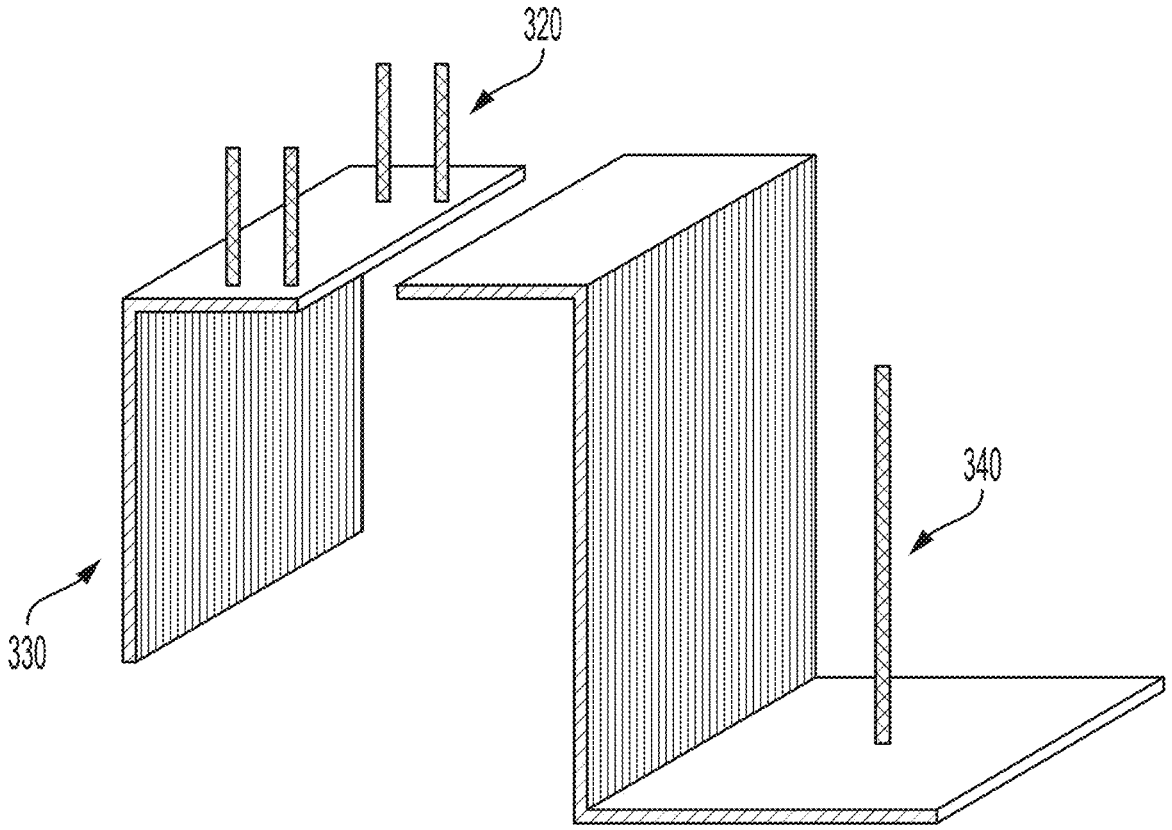
FIG. 3exemplarily illustrates an anchoring apparatus according to one or more aspects of the invention.

Referring to FIG. 3, which illustrates an isometric view of the Z-shaped apparatus 310, along with the L-shaped receiver plate 330-unanchored for a more detailed depiction of the four nut-torqued rods 320 traversing through each top wall of the receiver plate 330.

In continuing reference to FIGS. 1A, 2A, and 3, the preferred materials/fabrication techniques of the Z-shaped anchoring plate 110, 210, 310 calls for all steel to be schedule 36, wherein the first element 110*a*, 210*a*; second element 110*c*, 210*c*; and middle element 110*b* of the Z-plate 110, 210, 310 is continuously welded/bent. The second element 110*c*, 210*c* of the Z-plate 110, 210, 310 is further disposed with a continuously welded counter weight rod 140, 240, 340. The L-shaped receiver plate 130, 230, 330—also continuously welded/bent schedule 36 steel—is dimensioned and configured to accommodate the Z-shaped plate for securely anchor over/through the parapet. In some embodiments, the Z-shaped anchoring apparatus is minimally/not invasive and does not have any nut-torqued rods traversing through a parapet—and instead, rests over a top wall of the (optionally, reinforced) parapet. In other embodiments, the Z-shaped anchoring apparatus does nut-torqued rod anchor through a top wall and/or vertical wall (outer/inner) of the parapet-appropriate in instances of higher stress tolerance of the parapet. The dimensions of each element of a single Z-plate may be identical, or different depending on the use case of the apparatus (anchoring and/or tie-back). Preferably, the Z-plate element dimensions are 12 inch×36 inch×24 inch×7/8.

Figure 4A:
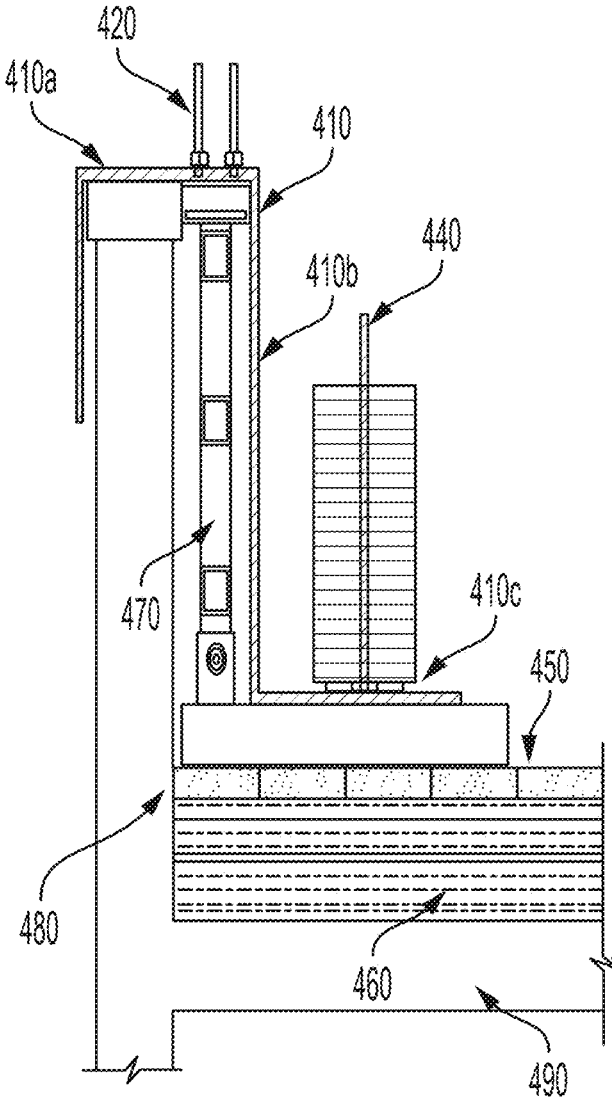
FIG. 4A exemplarily illustrates an anchoring apparatus according to one or more aspect of the present invention.
Figure 5A:
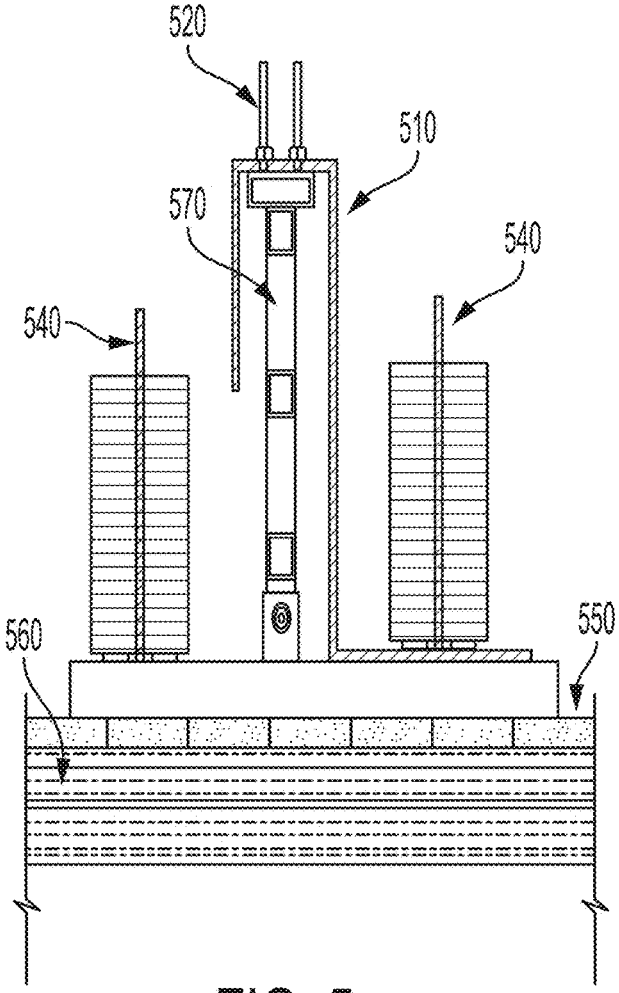
FIG. 5A exemplarily illustrates an anchoring apparatus according to one or more aspects of the invention.

Now in reference to FIGS. 4A and 5A, illustrating an arm-supported Z-shaped anchoring apparatus comprising: a Z-shaped anchoring plate 410, 510 comprised of a first horizontally protruding element 410*a*, 510*a*, a second opposable protruding element 410*c*, 510, and said elements continuously coupled to each other via a vertical middle element 410*b*, 510*b*; a vertical arm 470, 570 with a top surface and at least one vertical surface, wherein said arm 470, 570 positioned between the vertical middle element 410*b*, 510*b* and the first protruding element 410*a*, 510*a* of the Z-shaped plate 410, 510, wherein the Z plate 410, 510 is configured to securely cover at least portions of the top and vertical surfaces of the arm 470, 570 and a roof 490, 590; at least one rod-nut 420, 520 anchoring the top wall of the arm 470, 570 with the first element 410*a*, 510*a* of the anchoring plate and top wall of the parapet 480, in order to secure a suspended scaffold for vertical mobility for a user to engage a façade of a structure; and a counterweight 440, 540 securely rested on a top surface of the second element 410*c*, 510*c* in order to counter the weight of the suspended scaffold.

Figure 4B:
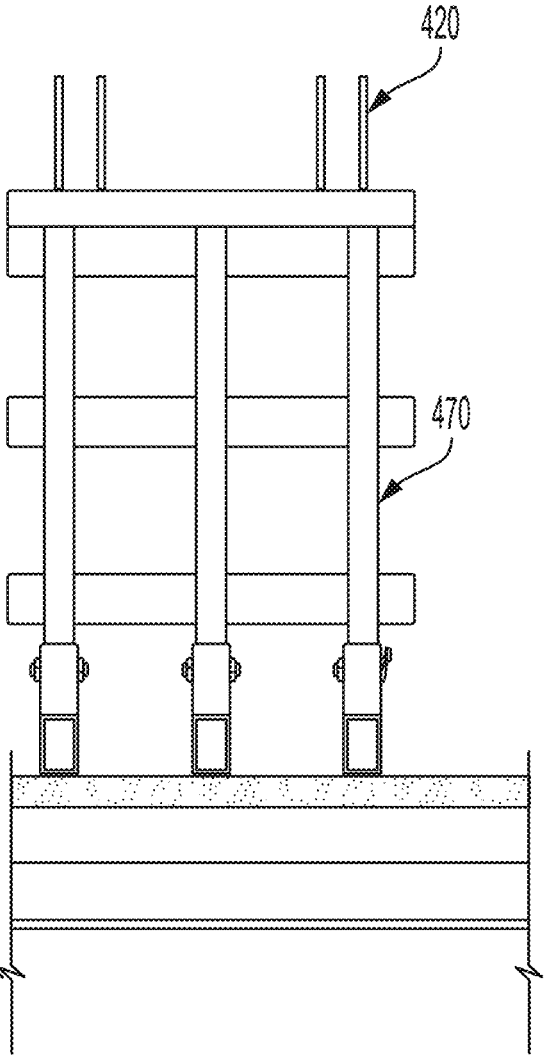
FIG. 4B exemplarily illustrates an anchoring apparatus according to one or more aspects of the invention.
Figure 5B:
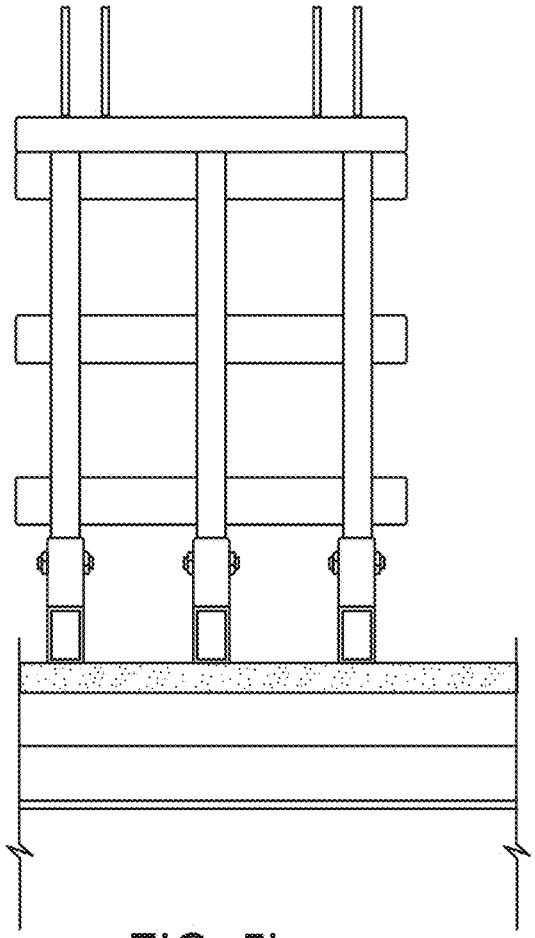
FIG. 5B exemplarily illustrates an anchoring apparatus according to one or more aspects of the invention.

The second element 410*c*, 510*c*, optionally, rests on a wood 450, 550/foam support 460, 560 for further reinforcement of the roof 490, 590. As shown, the threaded rods 420, 520 pins with nuts torqued to within a range of 10 KIPS and preferably four rods 420, 520 per first element 410*a*, 510*a* of the Z-plate 410, 510. As shown in FIG. 4A, the support arm 470 and the top wall of the parapet 480 are positioned below the first element 410*a* of the Z-plate 410, providing additional load-bearing support, while FIG. 5A depicts an exemplary free-standing apparatus without the use of a parapet—and just the support arm 570. The arm supported embodiment may not even contact the top wall of the parapet, as shown in FIG. 4A. The free-standing embodiment in FIG. 5A shows the use of an optional opposable counterweight resting on the wood 550 and foam 560 support. While not shown, the anchoring may be reinforced by having additional support arms between the Z-plate middle element and parapet. In yet other embodiments for super reinforcement, anchoring may occur on a top wall of the parapet, in addition to the single or multiple support arms. Further yet, anchoring may occur between the middle elements and first elements of the Z-plate engaged with distinct sites on the support arm. FIGS. 4B and 5B exemplarily illustrates a plan view of the support arm 470, 570, detailing the number and orientation of the nut-torqued rods 420, 520 traversing the top wall of the support arm 470, 570. As shown in the plan view of FIGS. 4B and 5B, there are three support arms 470, 570 vertically anchored under one of a Z-plate 410, 510 first element.

Figure 6:
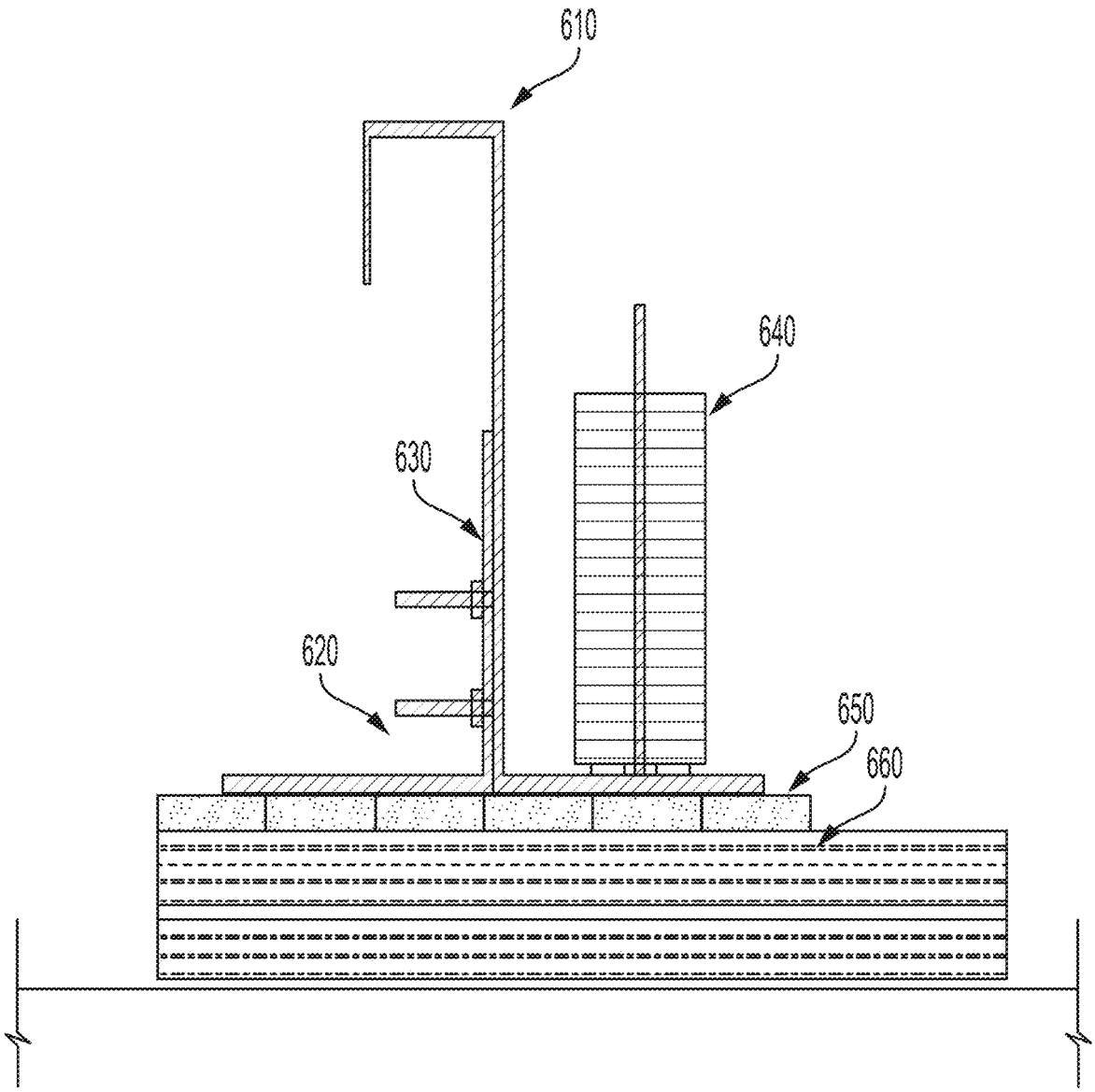
FIG. 6 exemplarily illustrates a method according to one or more aspect of the present invention.
Figure 7:
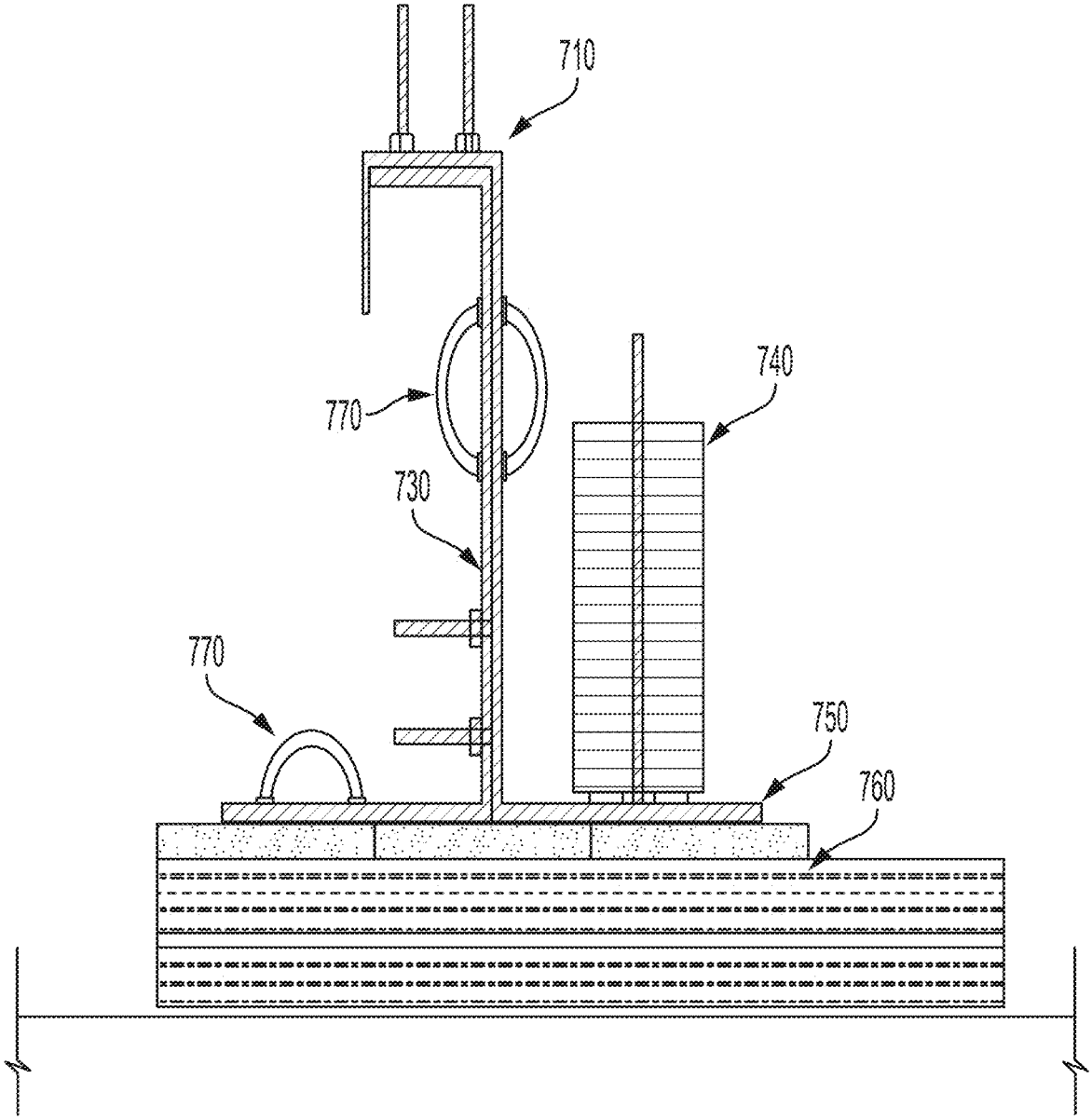
FIG. 7 exemplarily illustrates a method according to one or more aspect of the present invention.

Moving onto FIGS. 6 and 7, both of which illustrate an exemplary tie-back accessory for suspension scaffolding in accordance with an aspect of the invention. The apparatus comprising: a Z-shaped anchoring plate 610, 710 comprised of a first horizontally protruding element 610*a*, 710*a*, a second opposable protruding element 610*c*, 710*c*, and said elements continuously coupled to each other via a vertical middle element 610*b*, 710*b*; at least a single hole traversing at least one of the first element 610*a*, 710*a*, middle element 610*b*, 710*b*, or L-shaped receiver plate 630, 730, and configured to slidably receive a cable to serve as a tie-back distally situated from a suspended scaffold hanging from a proximal end; and a counterweight 640, 740 securely rested on a top surface of the second element 610*c*, 710*c* in order to counter the weight of the suspended scaffold.

FIG. 7 further illustrates a tie-back circular receiver 770 for accommodating a steel cable or any cable traditionally used to support/tie-back the weight of a distal scaffold. While two receivers 770 are shown in this exemplary embodiment, any number of receivers, positioned anywhere on the Z-plate 710 and/or L-shaped receiver plate 730 may by possible. In one embodiment, approximately a 1,000 pounds of counterweight 740 is necessary per Z-plate 710. The counterweight 740 may be disposed on a rod continuous with the second element of the Z-plate 710 or simply resting on the surface of the second element of the Z-plate 710. For additional roofing support, the Z-plate 710 with counterweight 740 may rest on 2×10 wood planks 750, further supported on 100 PSI XPS foam insulation 760 as required to compensate for height differential of the parapet wall.

Figure 8:
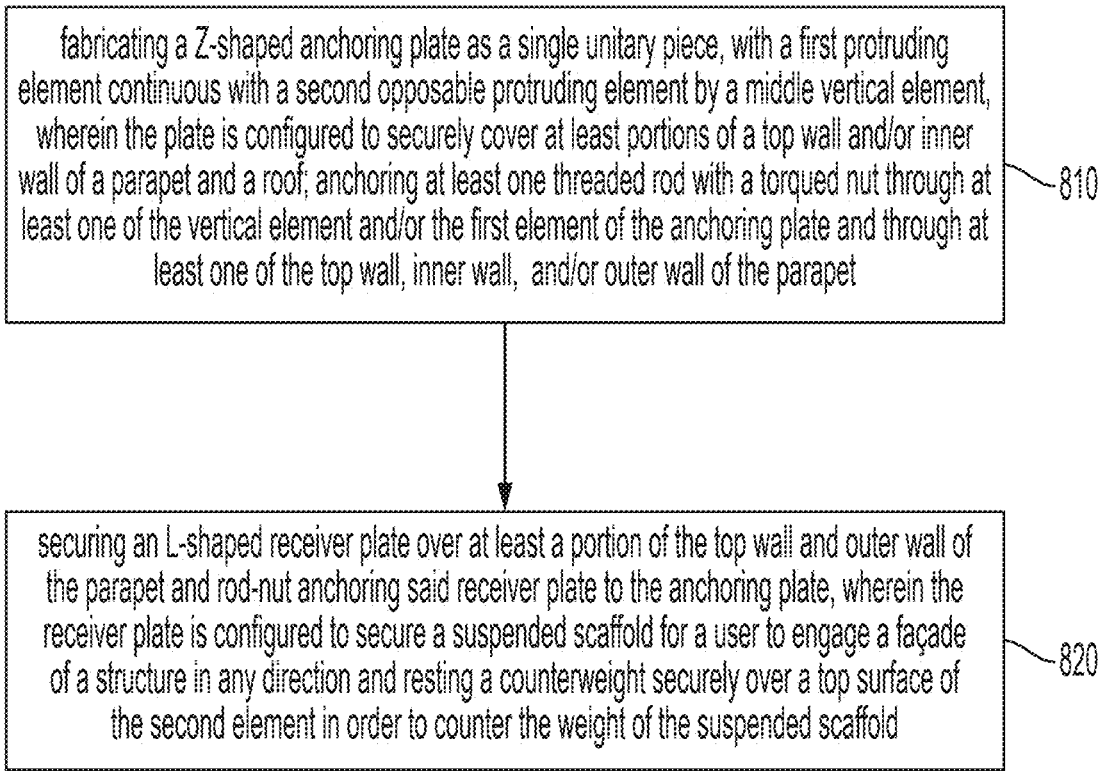
FIG. 8 illustrates an exemplary method flow diagram according to an embodiment of the present invention.

FIG. 8 illustrates an exemplary method flow diagram, entailing the steps of: fabricating a Z-shaped anchoring plate as a single unitary piece, with a first protruding element continuous with a second opposable protruding element by a middle vertical element, wherein the plate is configured to securely cover at least portions of a top wall and/or inner wall of a parapet and a roof; anchoring at least one threaded rod with a torqued nut through at least one of the vertical element and/or the first element of the anchoring plate and through at least one of the top wall, inner wall, and/or outer wall of the parapet 810; securing an L-shaped receiver plate over at least a portion of the top wall and outer wall of the parapet and rod-nut anchoring said receiver plate to the anchoring plate, wherein the receiver plate is configured to secure a suspended scaffold for a user to engage a façade of a structure in any direction and resting a counterweight securely over a top surface of the second element in order to counter the weight of the suspended scaffold 820.

Figure 9:
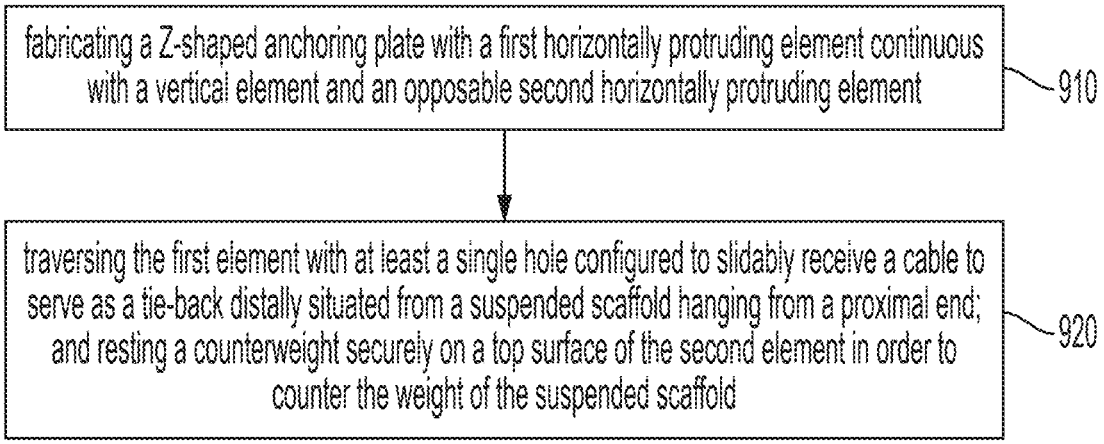
FIG. 9 illustrates an exemplary method flow diagram according to an embodiment of the present invention.

FIG. 9 also illustrates an exemplary method flow diagram, entailing the steps of: fabricating a Z-shaped anchoring plate with a first horizontally protruding element continuous with a vertical element and an opposable second horizontally protruding element 910; traversing the first element with at least a single hole configured to slidably receive a cable to serve as a tie-back distally situated from a suspended scaffold hanging from a proximal end; and resting a counterweight securely on a top surface of the second element in order to counter the weight of the suspended scaffold 920.

Although a single embodiment of the invention has been illustrated in the accompanying drawings and described in the above detailed description, it will be understood that the invention is not limited to the embodiment developed herein, but is capable of numerous rearrangements, modifications, substitutions of parts and elements without departing from the spirit and scope of the invention.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. An apparatus for suspended scaffolding, said apparatus comprising:

a Z-shaped anchoring plate comprised of a first horizontally protruding element, a second opposable protruding element, and said elements continuously coupled to each other via a vertical middle element, wherein the Z-shaped plate is configured to securely cover at least portions of a top wall, inner wall of a parapet, and a roof;

at least one threaded rod with torqued nut anchored through at least one of the vertical element and/or the first element of the anchoring plate and through at least one of the top wall, inner wall, and/or outer wall of the parapet;

an L-shaped receiver plate secured over at least a portion of the top wall and outer wall of the parapet and rod-nut anchored to the anchoring plate, wherein the receiver plate is configured to secure a suspended scaffold for a user to engage a façade of a structure in any direction; and a counterweight securely rested on a top surface of the second element in order to counter the weight of the suspended scaffold.

2. The apparatus of claim 1, wherein the Z-shaped anchoring plate is fabricated from steel of a predetermined schedule.

3. The apparatus of claim 1, wherein the first element and second element are identical dimensions.

4. The apparatus of claim 1, wherein the first element and second element are different dimensions.

5. The apparatus of claim 1, wherein the Z-shaped anchoring apparatus is unitary, with the first element coupled to the second element via the middle element seamlessly formed between.

6. The apparatus of claim 1, wherein the second element rests on a support structure positioned between the second element and the roof of a structure.

7. The apparatus of claim 1, wherein the threaded rod with torqued nut traverses at least a portion of the anchoring plate and the parapet.

8. The apparatus of claim 7, wherein the traversal is on the first element and/or middle element of the anchoring plate, depending on the point of traversal of the parapet being on the top wall or inner/outer wall of the parapet.

9. The apparatus of claim 1, wherein the L-shaped receiver forms a mount over the parapet top wall for securing the suspended scaffold.

* * * * *